US008863787B2

(12) United States Patent
Garrigan

(10) Patent No.: US 8,863,787 B2
(45) Date of Patent: Oct. 21, 2014

(54) PAINT DISPENSING NOZZLE ARRANGEMENT

(75) Inventor: Owen Anthony Garrigan, Stokesley (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 875 days.

(21) Appl. No.: 12/663,936

(22) PCT Filed: Jun. 13, 2008

(86) PCT No.: PCT/EP2008/004757

§ 371 (c)(1),
(2), (4) Date: Apr. 7, 2010

(87) PCT Pub. No.: WO2008/151813

PCT Pub. Date: Dec. 18, 2008

(65) Prior Publication Data

US 2010/0200108 A1 Aug. 12, 2010

(30) Foreign Application Priority Data

Jun. 14, 2007 (GB) ..... 0711511.6

(51) Int. Cl.
*B05C 17/00* (2006.01)

(52) U.S. Cl.
USPC ..... 141/20.5; 139/288; 139/103; 401/118; 401/119

(58) Field of Classification Search
USPC ..... 141/20.5, 110, 112; 239/103, 288; 401/118, 119, 123, 126, 130
See application file for complete search history.

(56) References Cited

U.S. PATENT DOCUMENTS

| | | | | | |
|---|---|---|---|---|---|
| 1,714,350 | A | * | 5/1929 | De Jong | 401/205 |
| 2,119,043 | A | * | 5/1938 | Cornelison | 118/301 |
| 2,913,151 | A | * | 11/1959 | Wiseman et al. | 222/323 |
| 3,020,579 | A | * | 2/1962 | O'Connor | 401/188 R |
| 3,583,634 | A | * | 6/1971 | Sheetz | 239/103 |
| 3,952,955 | A | * | 4/1976 | Clements | 239/288.5 |
| 3,967,660 | A | | 7/1976 | Russell | |
| 4,192,462 | A | * | 3/1980 | Erickson | 239/288 |

(Continued)

FOREIGN PATENT DOCUMENTS

| | | |
|---|---|---|
| EP | 0 002 037 | 5/1979 |
| FR | 2 757 794 | 7/1998 |

(Continued)

OTHER PUBLICATIONS

International Search Report and Written Opinion of the International Searching Authority, International Application No. PCT/EP2008/004757, dated Sep. 30, 2008.

(Continued)

*Primary Examiner* — Timothy L Maust
*Assistant Examiner* — Robert Bell, III
(74) *Attorney, Agent, or Firm* — Kenyon & Kenyon LLP

(57) ABSTRACT

A paint dispensing nozzle arrangement for dispensing paint into a paint applicator, the paint applicator having a base plate, an interface material to allow the paint to adhere to the base plate, and a removable paint mold, the nozzle arrangement comprising a dispensing nozzle for dispensing paint into the paint mold, and a displacement member, the displacement member arranged relative to the dispensing nozzle such that the nozzle can dispense paint into the paint mold without coming into contact with the interface material.

8 Claims, 3 Drawing Sheets

(56) References Cited

U.S. PATENT DOCUMENTS

| | | | | |
|---|---|---|---|---|
| 4,231,668 | A * | 11/1980 | Groth et al. | 401/146 |
| 4,250,586 | A * | 2/1981 | Timian | 15/22.1 |
| 4,279,526 | A * | 7/1981 | McMullan | 401/97 |
| 4,331,296 | A * | 5/1982 | Levey | 239/288 |
| 4,552,477 | A * | 11/1985 | Braithwaite et al. | 401/188 R |
| 4,567,926 | A | 2/1986 | Lichfield et al. | |
| 4,685,621 | A * | 8/1987 | Scherer et al. | 239/288 |
| 4,695,176 | A * | 9/1987 | Simonette et al. | 401/144 |
| 4,717,074 | A * | 1/1988 | Karliner et al. | 239/288 |
| 4,767,056 | A * | 8/1988 | Demetrius et al. | 239/288 |
| 4,806,037 | A * | 2/1989 | Berglund | 401/6 |
| 5,285,965 | A * | 2/1994 | McCutcheon et al. | 239/288 |
| 5,454,646 | A * | 10/1995 | Reisdorf | 384/99 |
| 6,099,184 | A * | 8/2000 | Koptis | 401/190 |
| 7,407,336 | B2 * | 8/2008 | Giacomo | 401/287 |
| 7,491,005 | B2 * | 2/2009 | Blom | 401/137 |
| 8,276,538 | B2 * | 10/2012 | Ling et al. | 118/264 |
| 2008/0145137 | A1 * | 6/2008 | Bruggeman et al. | 401/205 |
| 2010/0307375 | A1 * | 12/2010 | Wren | 106/15.05 |

FOREIGN PATENT DOCUMENTS

| | | |
|---|---|---|
| JP | 59-194848 | 11/1984 |
| JP | 6-329102 | 11/1994 |
| JP | 07 285518 | 10/1995 |
| JP | 2004-262463 | 9/2004 |

OTHER PUBLICATIONS

International Preliminary Report on Patentability, International Application No. PCT/EP2008/004757, dated Dec. 17, 2009.

Search Report, European Patent Application No. RS 115547 GB, dated Jan. 24, 2008.

* cited by examiner

PAINT DISPENSING NOZZLE ARRANGEMENT

The present invention relates to a paint dispensing nozzle arrangement, in particular to a nozzle arrangement for dispensing a paint composition into a solid paint applicator.

Our co-pending patent applications; GB0606468.7 and GB0606467.9, the contents of which are herein incorporated by reference, describe an aqueous paint composition which can be formed into a solid paint body where the paint body can then be incorporated into a solid paint applicator to enable the paint composition to be applied to a surface such as a wall or ceiling.

The solid paint applicator comprises a base plate onto which a foam interface material is adhered, and a paint mould which is temporarily attached to the base plate to shape and retain the aqueous coating composition while it cools. The solid paint body is formed by heating the coating composition and then dispensing it into the paint mould using a paint filling machine having a paint dispensing nozzle, and then allowing it to cool. The mould is removed once the coating composition has cooled sufficiently such that it is self supporting and dimensionally stable. The foam interface material allows the solid paint body to adhere indirectly to the base plate.

The base plate includes a filling hole through which the coating composition from the dispensing nozzle can flow into the mould. The foam interface must have substantial contact with the paint body to enable the paint body to adhere to it, and therefore, so as to minimise the loss in contact area with the paint body, the foam includes a cut, for example, a cruciform cut positioned directly below the filling hole to allow penetration by the dispensing nozzle when the mould is being filled.

A problem with such an arrangement is that in order to dispense the coating composition into the mould, the nozzle must penetrate the foam interface, which then becomes contaminated with coating composition as the nozzle is withdrawn from the mould.

An object of the present invention is to provide a dispensing nozzle which overcomes this problem.

Thus, according to the present invention there is provided a paint dispensing nozzle arrangement for dispensing paint into a paint applicator, the paint applicator having a base plate, an interface material to allow the paint to adhere to the base plate, and a removable paint mould, the nozzle arrangement comprising a dispensing nozzle for dispensing paint into the paint mould, and a displacement member, the displacement member arranged relative to the dispensing nozzle such that the nozzle can dispense paint into the paint mould without coming into contact with the interface material.

Advantageously this prevents the dispensing nozzle from being contaminated with paint when the mould is filled. It also prevents the nozzle from coming into contact with paint and disturbing the meniscus, and therefore minimises dripping.

Furthermore, the displacement member minimises the depth of immersion of the dispensing nozzle.

The invention will now be described by way of example only with reference to the accompany drawings, in which.

Figure 1:
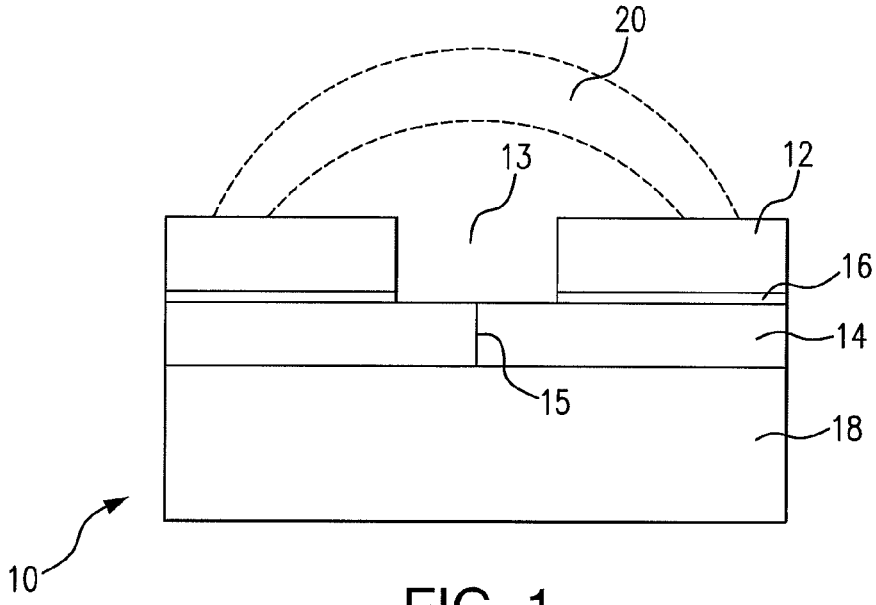
FIG. 1 is a sectional side view of a paint applicator.
Figure 2:
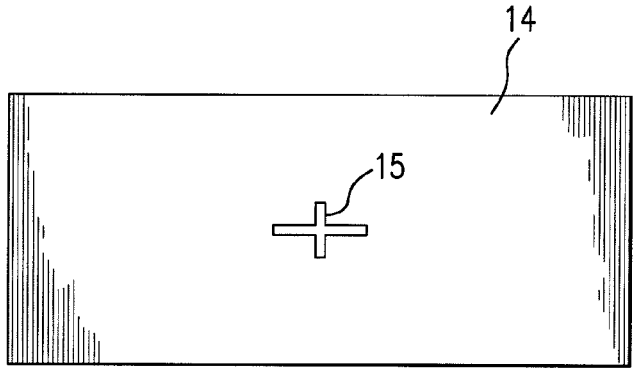
FIG. 2 is a plan view of part of the paint applicator of FIG. 1.
Figure 3:
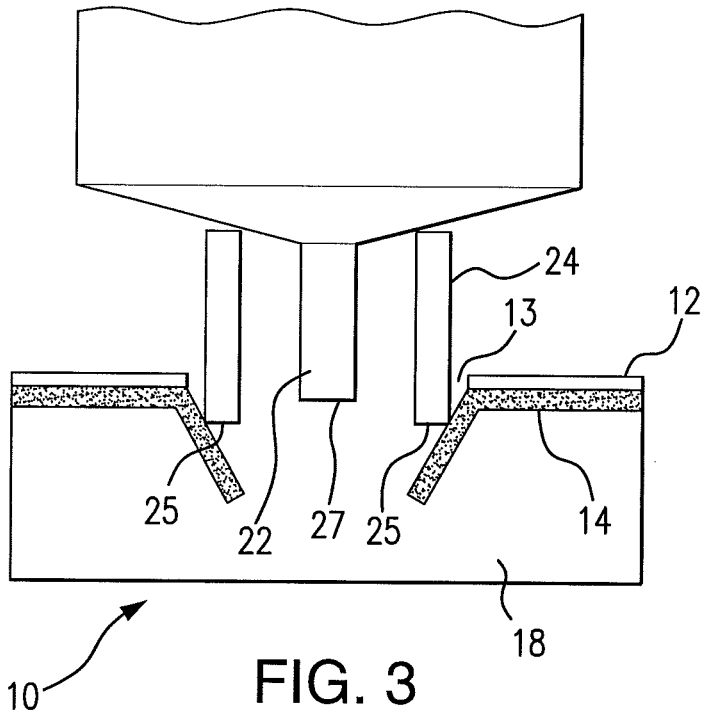
Figure 4:
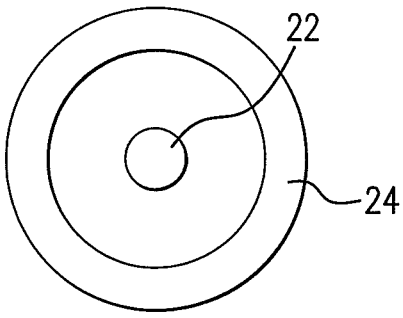
Figure 5:
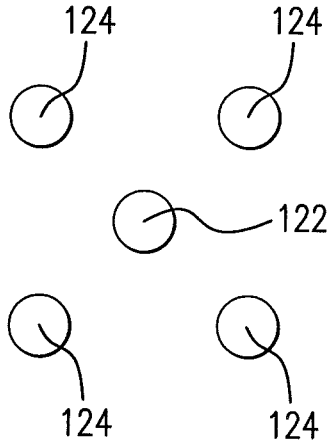
Figure 6:
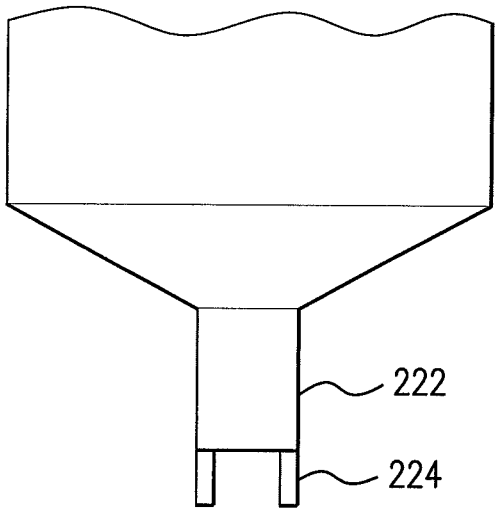
Figure 7:
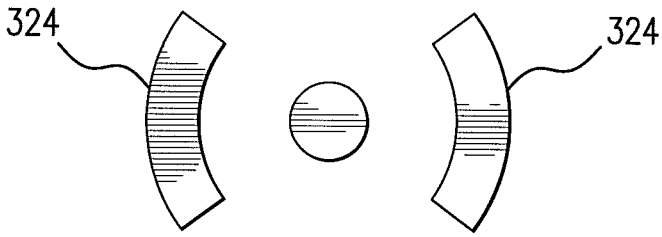

FIG. 3 is a sectional side view of the paint dispensing nozzle arrangement of the present invention in use with the paint applicator of FIG. 1, FIG. 4 is an underside plan view of the paint dispensing nozzle arrangement of FIG. 3, FIG. 5 is an underside plan view of an alternative paint dispensing nozzle arrangement, FIG. 6 is a sectional side view of an alternative paint dispensing nozzle arrangement, and FIG. 7 is an underside plan view of an alternative paint dispensing nozzle arrangement.

FIG. 1 shows a paint applicator 10 comprising a paint composition formed into a solid paint body 18 and attached to a foam interface in the form of a polyurethane sponge 14 which is attached to a polypropylene base plate 12 by means of a thin layer of adhesive 16. Attached to the base plate 12 is a releasable handle 20.

The paint composition comprises the ingredients of Table 1 below.

TABLE 1

| Component | wt % |
|---|---|
| Tap water | 16.00 |
| Benzyl alcohol | 0.80 |
| Texanol | 1.99 |
| Carboxylated pigment dispersant | 1.99 |
| Defoamer | 0.15 |
| Dolomite | 11.95 |
| China Clay | 10.00 |
| Rutile $TiO_2$ | 26.90 |
| Tap water | 6.89 |
| HMHEC[1] | 0.15 |
| Biocide | 0.02 |
| Latex[2] | 19.98 |
| Ammonia (0.880) | 0.15 |
| Defoamer | 0.03 |
| Fatty acid salt[3] | 3.00 |

[1]Hydrophobically Modified Hydroxy Ethyl Cellulose
[2]MMA/BA/AA latex terpolymer of 52.5 wt % solids Tg −6° C.
[3]60/40 mixture of sodium stearate and sodium palmitate It will be appreciated that the present invention is not limited to the paint composition detailed above, and is applicable to any paint composition that can be formed into a solid paint body with or without heating.

Typically the paint composition will include a binder polymer and a salt of a fatty acid.

An alternative paint composition includes from 1 to 6% chelating thickener and from 2 to 8% clay thickener, and furthermore does not require the heating stage described below in relation to the composition including a salt of a fatty acid.

The paint composition may also advantageously contain ingredients selected from the group consisting of pigments, fillers, extenders, solvents, plasticizers, flow additives, antifoams and antimicrobials.

The solid paint body is formed by heating the paint composition to 80° C. in a heating vessel (not shown) whilst stirring, and held at this temperature for 90 minutes after which time it is poured from the heating vessel via a paint dispensing nozzle 22 (shown in FIG. 3) into a sealable block shaped mould (not shown) of approximately 15 cm×10 cm×3 cm and allowed to cool and solidify overnight. The heating step may be carried out in a conventional vessel, heated for example using hot water or induction heating, before being transferred to the mould or container for cooling. Alternatively, the paint composition may be filled into a container, mould or die and heated in situ, by heating means and then subsequently cooled to below its melting temperature. Suitable heating means include microwave radiation, radiant heat, hot water or steam.

The base plate 12 has a filling hole 13 which allows the paint dispensing nozzle to be partially inserted therethrough such that the paint composition can be dispensed into the mould.

Similarly, the sponge 14 includes a cruciform cut 15 which is aligned vertically below the filling hole 13 such that the paint dispensing nozzle 22 can penetrate the sponge 14 and dispense paint into the mould. In an alternative embodiment, the sponge can include a different form of cut, for example a slit or a hole, the form of the cut allowing penetration of the dispensing nozzle.

When the hot liquid paint is poured into the mould, some of it flows into the sponge 14. On cooling, the paint solidifies into a self supporting and dimensionally stable solid paint body attached to the base plate 12 via the sponge 14. Once the paint has solidified, the mould is removed, and the handle 20 is attached to the base plate 12.

By solid paint body it is meant a self-supporting, dimensionally stable paint composition described above when formed into any shape suitable for painting. Preferably the paint body is shaped as a block having at least one, preferably flat, exposed surface which is used to apply the paint directly to the substrate.

By self-supporting, dimensionally stable is meant that the composition is solid enough to retain the shape into which it has been formed without the need for a container to support it. Also, it must be able to substantially retain its dimensions during the painting or application process. In other words, when in the form of a paint block, for example, the paint should be able to withstand the forces imparted on it without breaking up, whilst allowing a film of liquid paint to flow on to the substrate during painting. Clearly some transient deformation of the paint body or block will occur, but not to the extent that interrupts or prevents painting.

With reference to FIGS. 3 and 4, the dispensing nozzle 22 includes a displacement member in the form of annular ring 24 which is co-axial with the dispensing nozzle 22 and arranged such that its lowest point 25 is below the lowest point 27 of the dispensing nozzle 22. The annular ring 24 has a diameter greater than that of the dispensing nozzle 22.

When the dispensing nozzle 22 is inserted into the mould, the annular ring 24, by virtue of its greater diameter, displaces the cruciform cut 15 of the sponge 14 causing it to open up, thus providing an unobstructed path for paint to be dispensed into the mould and preventing contact between the dispensing nozzle 22 and the sponge 14. Furthermore, the annular ring 24 prevents paint already dispensed into the mould, or present on the sponge 14 from coming into contact with the dispensing nozzle 22, and therefore minimises dripping as the nozzle is withdrawn. The annular ring 24 also minimises the depth of immersion of the dispensing nozzle 22 as the nozzle itself is not required to displace the sponge 14.

In an alternative embodiment shown in FIG. 5, four equispaced prongs 124 arranged radially relative to the dispensing nozzle 122 can be used to displace the sponge instead of the annular ring of the embodiment of FIGS. 3 and 4.

In an alternative embodiment shown in FIG. 6, an annular ring 224 can be positioned below the nozzle 222 and have the same diameter. The fact that the annular ring is positioned below the nozzle enables it to displace the sponge without there being contact between the nozzle and the sponge.

In an alternative embodiment shown in FIG. 7, a partial annular ring 324 can be used which differs from the complete annular ring of FIGS. 3 and 4 in that two arc-like prongs are used to displace the sponge.

The invention claimed is:

1. A paint filling machine comprising a paint applicator having a base plate, a removable paint mould, an interface material to allow the paint to adhere to the base plate, wherein the interface material is located between the base plate and the removable paint mould, and a paint dispensing nozzle arrangement for dispensing paint into the paint applicator, the nozzle arrangement comprising a dispensing nozzle for dispensing paint into the paint mould, and a displacement member, the displacement member arranged relative to the dispensing nozzle such that the nozzle can dispense paint into the paint mould without the nozzle coming into contact with the interface material.

2. The paint filling machine according to claim 1 wherein the displacement member displaces the interface material such that the nozzle can dispense paint into the paint mould without the nozzle coming into contact with the interface material.

3. The paint filling machine according to claim 1 wherein the lowest point of the displacement member is positioned vertically below the lowest point of the nozzle.

4. The paint filling machine according to claim 1 wherein the displacement member is an at least partial annular ring.

5. The paint filling machine according to claim 4 wherein the annular ring is positioned coaxially with the nozzle.

6. The paint filling machine according to claim 5 wherein the annular ring has a diameter greater than the nozzle diameter.

7. The paint filling machine according to claim 1 wherein the displacement member is at least two prongs.

8. The paint filling machine according to claim 1 wherein the displacement member is four prongs.

* * * * *